US008245338B1

(12) United States Patent
Nemeth

(10) Patent No.: US 8,245,338 B1
(45) Date of Patent: Aug. 21, 2012

(54) PORTABLE DIAPER CHANGING PAD DEVICE

(76) Inventor: Kerri A. Nemeth, Rahway, NJ (US)

( * ) Notice: Subject to any disclaimer, the term of this patent is extended or adjusted under 35 U.S.C. 154(b) by 0 days.

(21) Appl. No.: 13/113,515

(22) Filed: May 23, 2011

(51) Int. Cl.
*A47C 9/00* (2006.01)

(52) U.S. Cl. ..... 5/655; 5/502; 5/417

(58) Field of Classification Search ..... 5/655, 494, 5/502, 417, 420, 632
See application file for complete search history.

(56) References Cited

U.S. PATENT DOCUMENTS 4,886,150 A * 12/1989 Fitzsimmons ..... 190/1
4,999,863 A * 3/1991 Kane ..... 5/98.1
6,053,634 A * 4/2000 Kay ..... 383/4
6,125,487 A 10/2000 Ive
6,389,624 B1 5/2002 Madole
7,065,814 B2 * 6/2006 Rutkowski ..... 5/655

* cited by examiner

*Primary Examiner* — Fredrick Conley

(57) ABSTRACT

The portable diaper changing pad device provides a fully pliable pad that may be used on virtually any surface. The pliability of the pad is also advantageous for compact portability. Straps extended from each pad end are used to wrap around a given surface, such as an existing changing table for example, to removably secure the pad thereto. The pillow is made into the pad. Two restraint loops are provided proximal to the pillow for looping around an infant' shoulders. The connecting strap with adjustable buckle removably secures the loops together so that a baby is restrained. The carry bag is especially useful for compact carry of the pad, and importantly features attachment means for removable attachment to the pad, when the pad is in use, so that the pad and carry bag are not inadvertently separated, with neither being easily accidentally forgotten.

2 Claims, 4 Drawing Sheets

PORTABLE DIAPER CHANGING PAD DEVICE

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Finding a sanitary surface upon which to change a baby's diaper is usually quite a task. Additionally, using those provided in various public facilities is fraught with danger of contamination with various bacteria and viruses. Also, many children need to be restrained, and public changing tables do not offer this feature. The present device solves these problems with a portable padded device with restraints, housed in a carry bag.

FIELD OF THE INVENTION

The portable diaper changing pad device relates to portable mats and pads used as diaper changing surfaces.

SUMMARY OF THE INVENTION

The general purpose of the portable diaper changing pad device, described subsequently in greater detail, is to provide a portable diaper changing pad device which has many novel features that result in an improved portable diaper changing pad device which is not anticipated, rendered obvious, suggested, or even implied by prior art, either alone or in combination thereof.

To attain this, the portable diaper changing pad device provides a fully pliable pad that may be used on virtually any surface. The pliability of the pad is also advantageous for compact portability. The pad may be made of many materials and may also have outer surfaces that are moisture proof and bactericidal and fungicidal. The straps extended from each pad end are used to wrap around a given surface, such as an existing changing table for example, to removably secure the pad thereto with various strap-to-strap attachment means provided. The pillow is made into the pad. Two restraint loops are provided proximal to the pillow for looping around an infant' shoulders. The connecting strap with adjustable buckle removably secures the loops together so that a baby is restrained.

The carry bag is especially useful for compact carry of the pad, and importantly features attachment means for removable attachment to the pad, when the pad is in use, so that the pad and carry bag are not inadvertently separated, with neither being easily accidentally forgotten.

Importantly, the device can be used on an existing diaper changing station, or other chosen surface, and securely and removably attached thereto. This use provides an excellent and sanitary changing surface that, again, restrains a baby.

Thus has been broadly outlined the more important features of the improved portable diaper changing pad device so that the detailed description thereof that follows may be better understood and in order that the present contribution to the art may be better appreciated.

An object of the portable diaper changing pad device is to provide a soft surface for changing a baby's diaper.

Another object of the portable diaper changing pad device is to provide a means for anchoring the pad to a given surface.

A further object of the portable diaper changing pad device is to provide a pad that negates specific folding such that the device is significantly compact and pliable.

An added object of the portable diaper changing pad device is to provide a means for restraining a baby during diaper changes And, an object of the portable diaper changing pad device is to provide a carry bag that is not easily lost.

These together with additional objects, features and advantages of the improved portable diaper changing pad device will be readily apparent to those of ordinary skill in the art upon reading the following detailed description of presently preferred, but nonetheless illustrative, embodiments of the improved portable diaper changing pad device when taken in conjunction with the accompanying drawings.

DETAILED DESCRIPTION OF THE DRAWINGS

With reference now to the drawings, and in particular FIGS. 1 through 5 thereof, the principles and concepts of the portable diaper changing pad device generally designated by the reference number 10 will be described.

Figure 1:
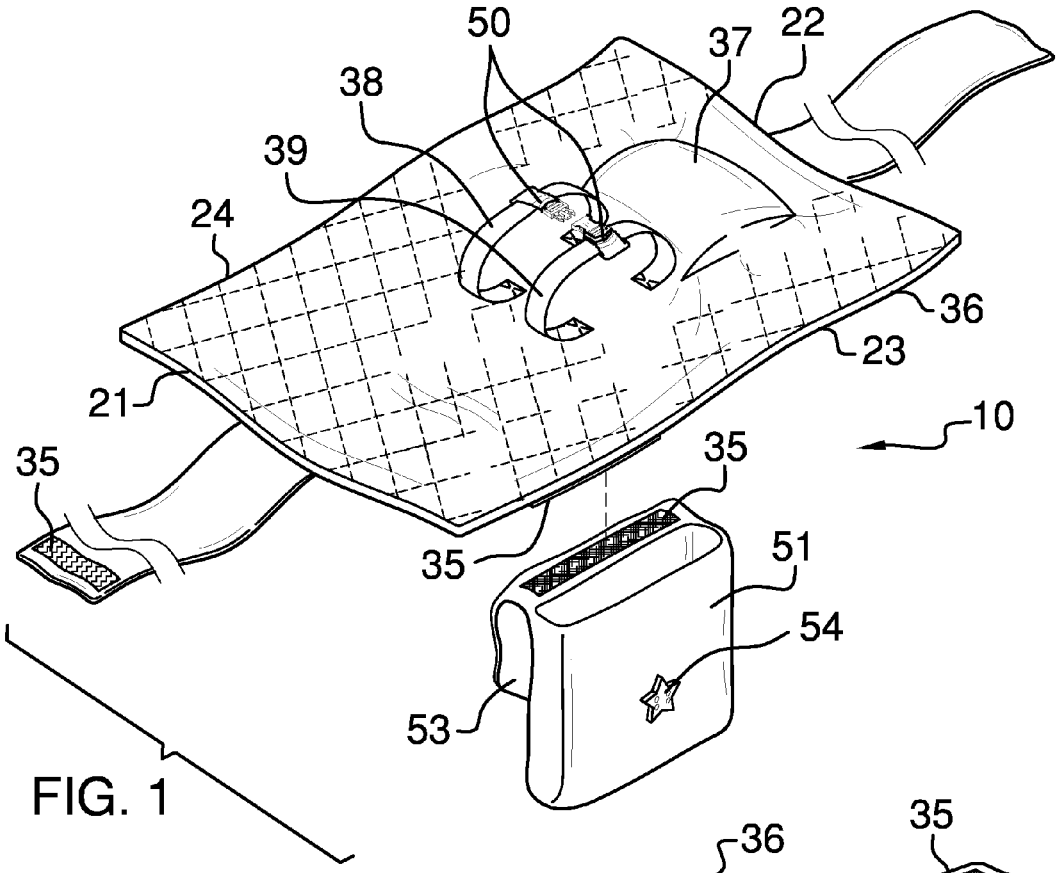
FIG. 1 is a top perspective view.

Referring to FIG. 1, the device 10 partially comprises the padded fully pliable pad 20 having a first end 21 spaced apart from the second end 22, and a first side 23 spaced apart from a second side 24.

Figure 2:
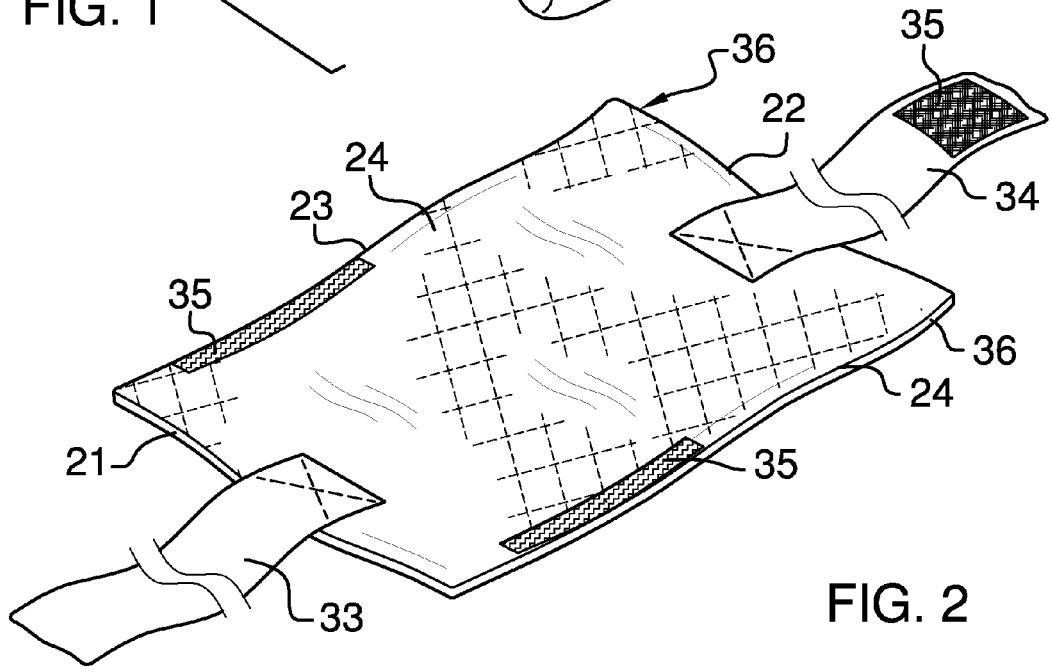
FIG. 2 is a bottom perspective view.

Continuing to refer to FIG. 1 and referring also to FIG. 2 the device 10 pad20 further comprises a top 25 and a bottom 26. The first strap 33 is extended centrally and perpendicularly from the first end 21. The second strap 34 is extended centrally and perpendicularly from the second end 22. An elongated hook and loop strip 35 is disposed distally on each strap. The hook and loop strip 35 is disposed on the pad 20 bottom 26 adjacent to each side and most proximal to the first end 21. The pillow 37 is disposed centrally within the pad 20 proximal to the second end 22.

Figure 4:
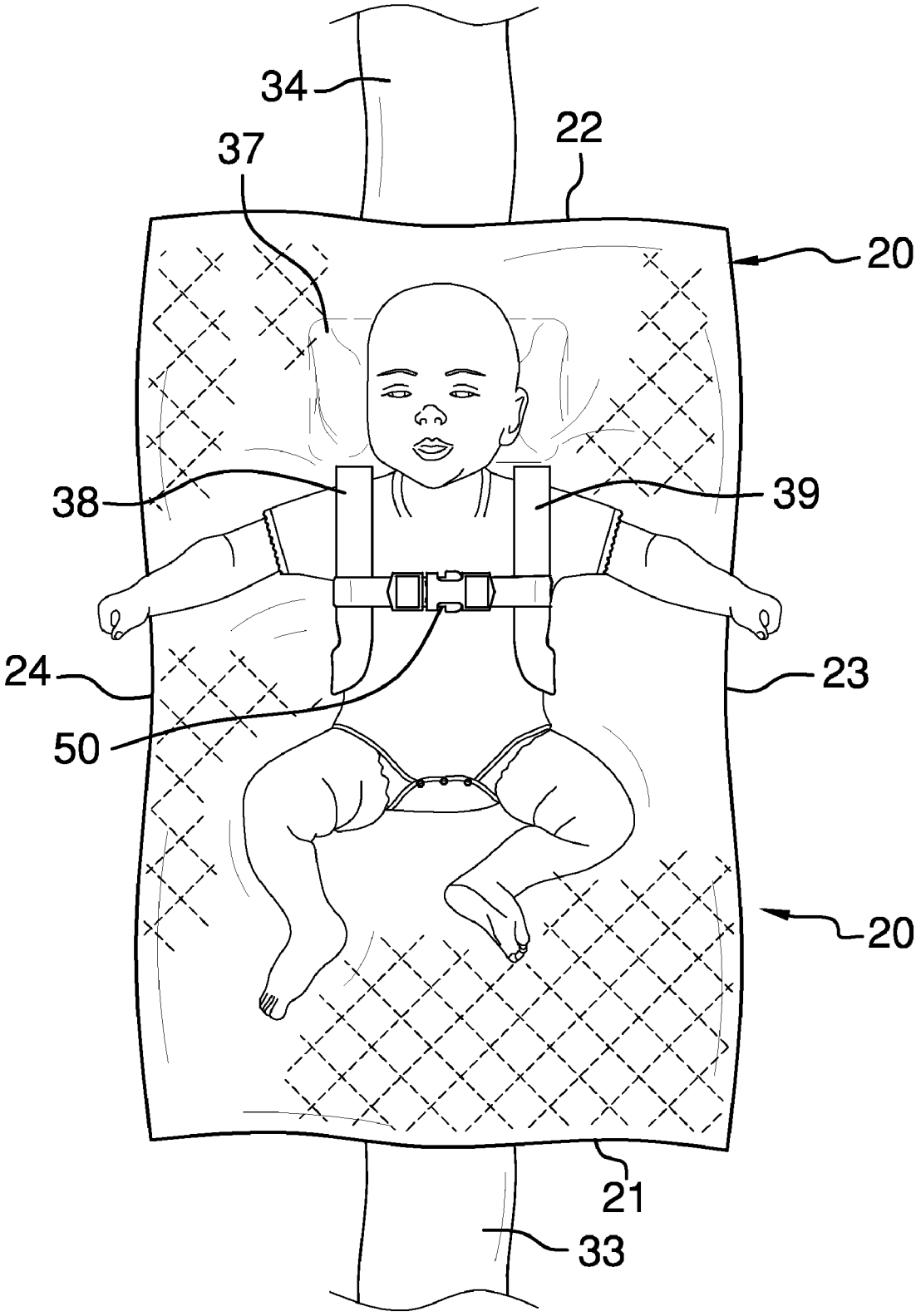
FIG. 4 is an in-use top plan view.

Referring to FIG. 4 and also to FIG. 1, the first restraint loop 38 is disposed longitudinally within the pad 20, proximal to the pillow 37 and most proximal to the second side 24. The second restraint loop 39 is disposed longitudinally within the pad 20, proximal to the pillow 37 and most proximal to the first side 23. The connecting strap with adjustable buckle 50 connects the restraint loops.

Figure 3:
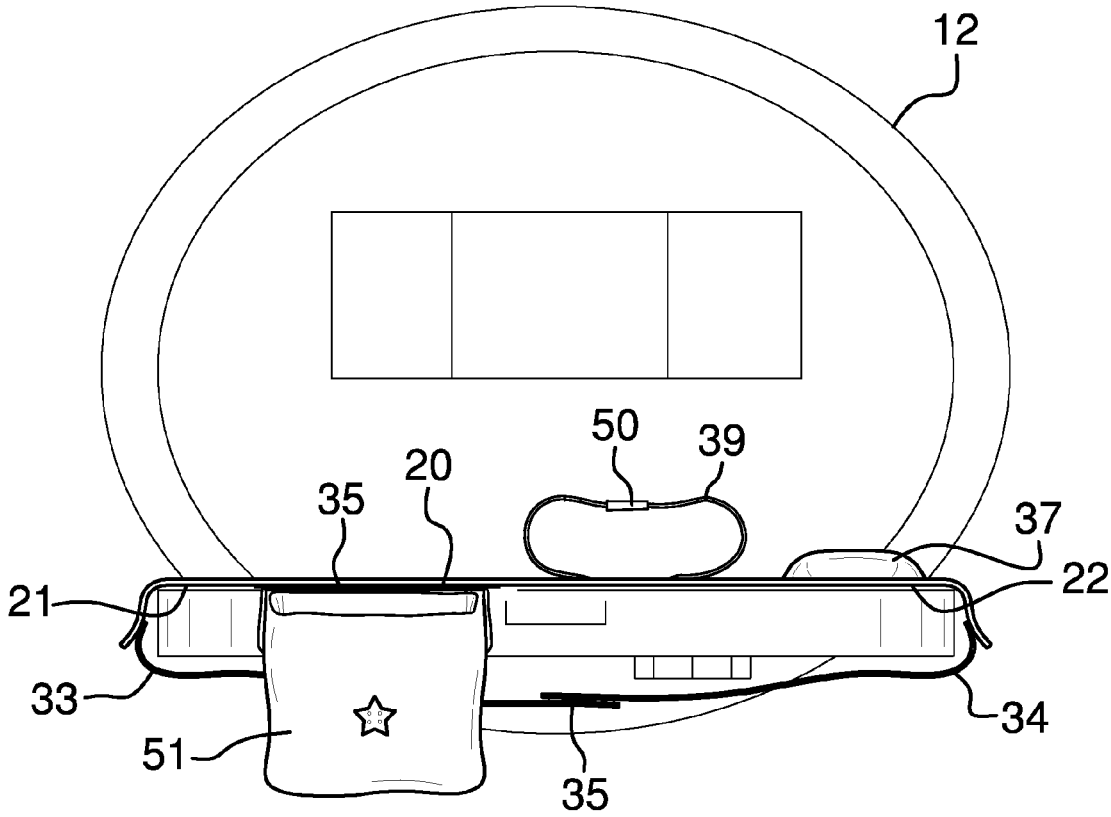
FIG. 3 is a lateral elevation view.

Referring to FIG. 3, the carry bag 51 with flap 53 has hook and loop 35 disposed on an underside.

Figure 5:
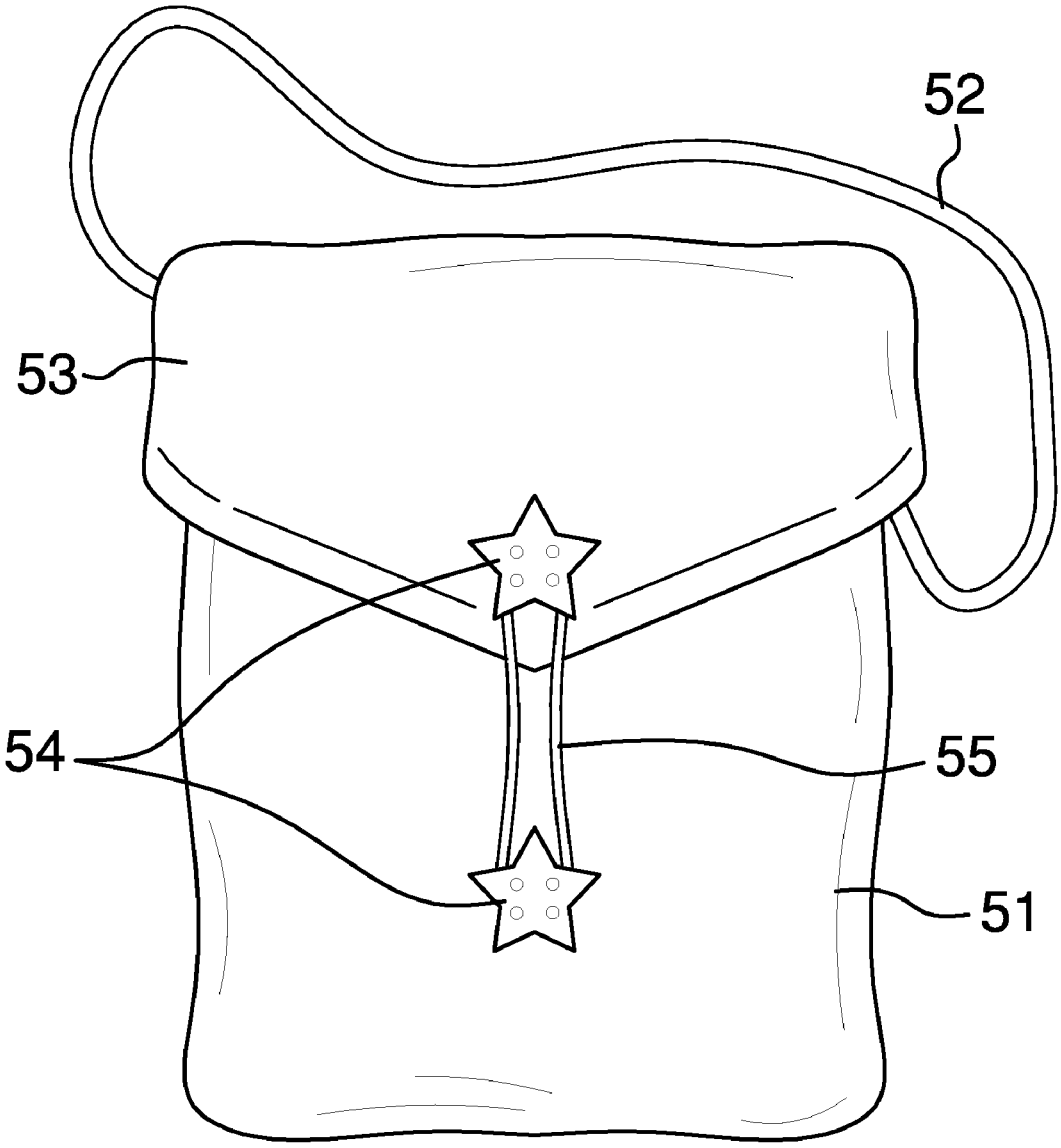
FIG. 5 is a front elevation view of the carry bag.

Referring to FIG. 5, a button 54 is disposed on the flap 53 and on a front of the carry bag 51. The loop 55 removably connects the buttons 54.

Referring to FIG. 3, an example of the device 10 sees the first strap 33 connected to the second strap 34 and both straps selectively wrapped and secured around a pivotal base of an existing changing table 12 to secure the device 10 against inadvertent movement while providing a sanitary controlling pad 20 for an infant during diaper change or other needed hygiene practices.

Directional terms such as "front", "back", "in", "out", "downward", "upper", "lower", and the like may have been used in the description. These terms are applicable to the embodiments shown and described in conjunction with the drawings. These terms are merely used for the purpose of description in connection with the drawings and do not necessarily apply to the position in which the portable diaper changing pad device may be used.

What is claimed is:

1. A portable diaper changing pad device comprising, in combination:

a padded fully pliable pad having a first end spaced apart from a second end, a first side spaced apart from a second side, a top, and a bottom;

a first strap extended centrally and perpendicularly from the first end;

a second strap extended centrally and perpendicularly from the second end;

a hook and loop disposed distally on each strap;

an elongated hook and loop strip disposed on the pad bottom adjacent to each side and most proximal to the first end;

a pillow disposed centrally within the pad proximal to the second end;

a first restraint loop disposed longitudinally within the pad, proximal to the pillow and most proximal to the second side;

a second restraint loop disposed longitudinally within the pad, proximal to the pillow and most proximal to the first side;

a connecting strap with adjustable buckle connecting the restraint loops.

2. A portable diaper changing pad device comprising, in combination:

a padded fully pliable pad having a first end spaced apart from a second end, a first side spaced apart from a second side, a top, and a bottom;

a first strap extended centrally and perpendicularly from the first end;

a second strap extended centrally and perpendicularly from the second end;

a hook and loop disposed distally on each strap;

an elongated hook and loop strip disposed on the pad bottom adjacent to each side and most proximal to the first end;

a pillow disposed centrally within the pad proximal to the second end;

a first restraint loop disposed longitudinally within the pad, proximal to the pillow and most proximal to the second side;

a second restraint loop disposed longitudinally within the pad, proximal to the pillow and most proximal to the first side;

a connecting strap with adjustable buckle connecting the restraint loops;

a carry bag with flap having hook and loop on an underside;

a button disposed on the flap and on a front of the carry bag;

a loop removably connecting the buttons.

* * * * *